US009938862B2

(12) United States Patent
Chandler et al.

(10) Patent No.: US 9,938,862 B2
(45) Date of Patent: Apr. 10, 2018

(54) DUAL FEED HYDRAULIC LASH ADJUSTER WITH INTEGRATED DE-AERATION RESTRICTION

(71) Applicant: Schaeffler Technologies AG & Co. KG, Herzogenaurach (DE)

(72) Inventors: David Chandler, Windsor (CA); Pradeep Mohan Mohan Das, Troy, MI (US); Peter Sailer, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 62 days.

(21) Appl. No.: 15/233,247

(22) Filed: Aug. 10, 2016

(65) Prior Publication Data

US 2018/0045085 A1 Feb. 15, 2018

(51) Int. Cl.
*F01L 1/14* (2006.01)
*F01L 1/24* (2006.01)

(52) U.S. Cl.
CPC ..... *F01L 1/2405* (2013.01); *F01L 2001/2444* (2013.01)

(58) Field of Classification Search
CPC . F01L 1/2405; F01L 1/267; F01L 2001/2444; F01L 13/0063; F01L 13/001; F01L 2105/00
See application file for complete search history.

(56) References Cited

U.S. PATENT DOCUMENTS

| | | | | |
|---|---|---|---|---|
| 6,758,175 | B2 | 7/2004 | Dinkel et al. | |
| 6,802,288 | B2 | 10/2004 | Spath | |
| 7,421,994 | B2 * | 9/2008 | Harris | F01L 1/2405 123/90.5 |
| 7,909,007 | B2 | 3/2011 | Manther et al. | |
| 8,235,017 | B2 | 8/2012 | Schafer et al. | |
| 8,662,035 | B1 | 3/2014 | Hendriksma | |
| 2010/0037845 | A1 | 2/2010 | Sailer et al. | |
| 2016/0102585 | A1 | 4/2016 | Evans | |

* cited by examiner

*Primary Examiner* — Zelalem Eshete
(74) *Attorney, Agent, or Firm* — Volpe and Koenig, P.C.

(57) ABSTRACT

A switching hydraulic fluid gallery de-aeration arrangement for a switchable valve arrangement is disclosed. A housing for a hydraulic lash adjuster assembly is positioned in a bore of a cylinder head. The housing includes a first, hydraulic lash adjuster fluid port in a first annular groove, and a second switching hydraulic fluid port in a second annular groove. A top land and a bottom land are positioned next to the annular grooves and each have a primary outer diameter. A middle land is defined axially between the grooves. The middle land has a reduced outer diameter relative to the primary outer diameter, or the bore has an annular groove between the top and bottom lands that defines a restricted flow path between a hydraulic lash adjuster fluid gallery and a switching hydraulic fluid gallery that maintains hydraulic fluid in the switching hydraulic fluid gallery.

16 Claims, 4 Drawing Sheets

DUAL FEED HYDRAULIC LASH ADJUSTER WITH INTEGRATED DE-AERATION RESTRICTION

FIELD OF INVENTION

The present invention relates to a switching hydraulic fluid gallery used in connection with switchable finger followers or switchable hydraulic lash adjusters.

BACKGROUND

Internal combustion engines include cylinder heads in which hydraulic lash adjusters are typically arranged which have hydraulic fluid galleries that feed pressurized hydraulic fluid, typically at a pressure of at least 0.5 bar, to a port defined in a housing of the hydraulic lash adjuster. A plunger is arranged within a bore of the housing and supports an end of a finger follower on a support head thereof. The plunger is axially displaceable to perform the hydraulic lash adjustment. For engines with cylinder deactivation technology, optionally a switching function can be performed by the hydraulic lash adjuster to provide a zero lift opening of the associated valve. When the switching function is provided, the hydraulic lash adjuster is provided as two parts in the form of an inner and outer housing, which are locked together for normal operation, and when deactivation is desired, a switching port of the housing feeds hydraulic fluid from a switching hydraulic fluid gallery, typically at a pressure of at least 1 bar, into a chamber of a locking pin to unlock the inner housing from the outer housing so that the inner housing can reciprocate within the outer housing. This is shown for example in U.S. Pat. No. 8,235,017.

It is also known to use switchable finger followers that have a first, hi-lift and a second, no or low-lift switching mode. Here, the switchable finger followers are activated or deactivated by pressurized hydraulic fluid that is fed via a feed path from the switching hydraulic fluid gallery, through the hydraulic lash adjuster, and to an actuator chamber in the switchable finger follower to actuate a switching function of the finger lever assembly between the first and second valve lift modes. See for example, U.S. Pat. No. 7,909,007. Other known arrangements for supplying hydraulic fluid in switchable valve trains are disclosed in U.S. Pat. No. 8,662,035, U.S. Pat. No. 6,758,175, U.S. Pat. No. 6,802,288, and U.S. Pub. 2010/0037845.

One known issue with switching hydraulic fluid galleries is that there can be a lag time for actuation of the switching function, whether in the hydraulic lash adjuster or in a switchable finger follower, due to air bubbles in the hydraulic fluid in the switching hydraulic fluid gallery or the switching hydraulic fluid path to the actuator, which at a minimum delays the switching time, affecting engine performance.

One known solution to de-aerate hydraulic fluid in a switching hydraulic fluid gallery is to provide a throttled passage via a local flat on an outer surface of a hydraulic lash adjuster housing. See for example, U.S. Pub. 2016/0102585, which is owned by the assignee of the present application. It would be desirable to provide a simplified solution for de-aeration of hydraulic fluid in a switching hydraulic fluid gallery arrangement.

SUMMARY

A switching hydraulic fluid gallery arrangement for a switchable valve arrangement including a simplified de-aeration feature is disclosed. The arrangement includes a cylinder head having a bore, a hydraulic lash adjuster fluid gallery that intersects the bore at a first intersection, and a switching hydraulic fluid gallery that intersects the bore at a second intersection offset from the first intersection. The arrangement includes a hydraulic lash adjuster assembly including a housing positioned in the bore of the cylinder head including a first, hydraulic lash adjuster fluid port on a radially outer wall in a first annular groove of the housing at the first intersection, and a second switching hydraulic fluid port on the radially outer wall in a second annular groove of the housing at the second intersection. The housing includes a top land positioned axially above the first annular groove, and a bottom land positioned axially below the second annular groove. The top land and the bottom land are cylindrical and each have a primary outer diameter ($D_P$). The housing includes a middle land defined axially between the first annular groove and the second annular groove. The middle land is cylindrical and has an outer diameter ($D_R$) that is reduced relative to the primary outer diameter ($D_P$). This reduced outer diameter ($D_R$) of the middle land provides a simplified arrangement for defining a restricted flow path between the hydraulic lash adjuster fluid gallery and the switching hydraulic fluid gallery to maintain hydraulic fluid in the switching hydraulic fluid gallery. A plunger is arranged within the housing that is axially displaceable therein. A switching control valve is connected to a pressurized fluid source, and the switching control valve is adapted to activate or deactivate the switchable valve arrangement. The switching control valve is movable from: (1) a first position, in which pressurized hydraulic fluid from the hydraulic lash adjuster fluid gallery flows to the first intersection, through the restricted flow path and through the switching hydraulic fluid gallery to a check valve such that pressurized hydraulic fluid from the hydraulic lash adjuster fluid gallery pressurizes the switching hydraulic fluid gallery and is released through the check valve, and (2) a second position, in which pressurized hydraulic fluid having a higher pressure sufficient for carrying out a switching function of the switchable valve arrangement is delivered by the switching hydraulic fluid gallery via the second intersection to the second port.

In another embodiment, the top land, the middle land, and bottom land all have the same outer diameter ($D_{P'}$), and an annular groove is formed in the bore in a region of the middle land. The annular groove provides a restricted flow path between the first annular groove and the second annular groove. The annular groove has a radial depth ($r_{R'}$) that provides the same function as the restricted flow path discussed above.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
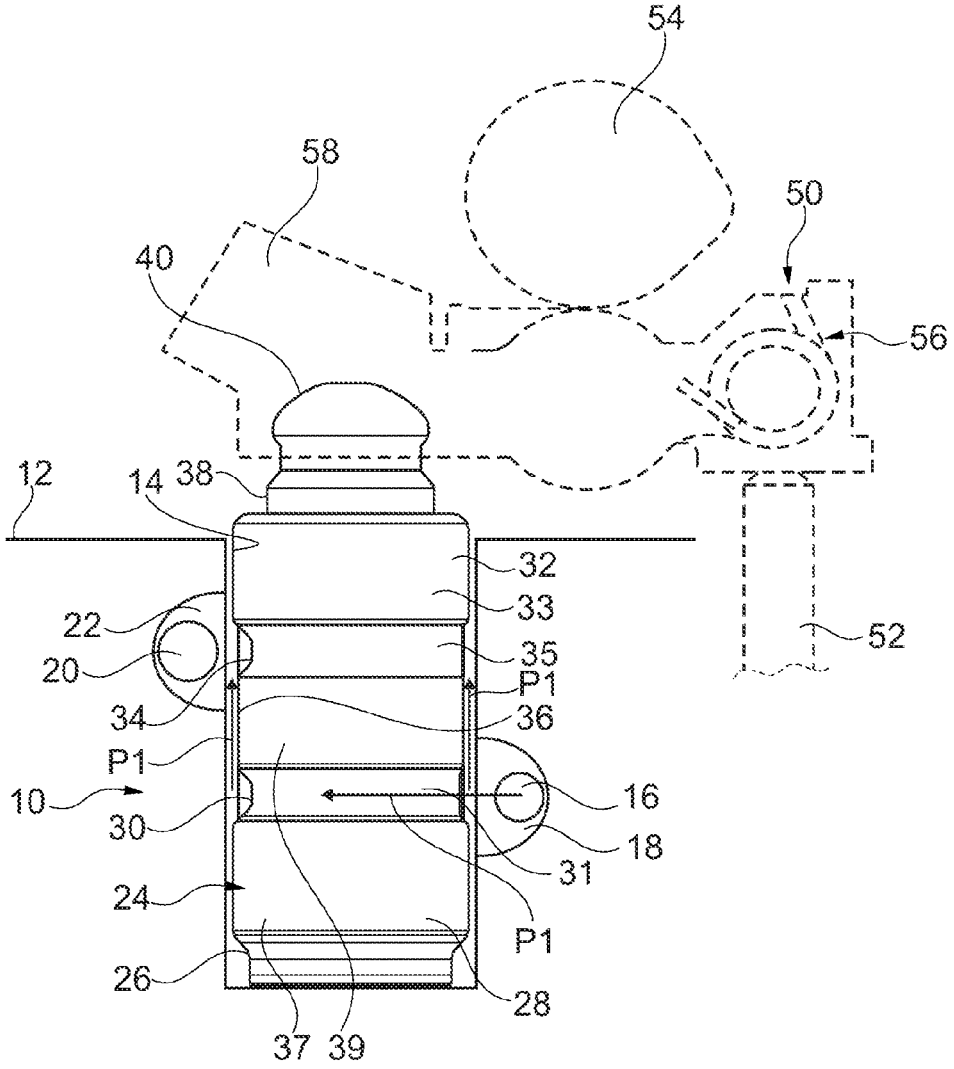
FIG. 1 is cross-sectional view through a cylinder head showing a switching hydraulic fluid gallery de-aeration arrangement for a switching valve arrangement used with a switchable roller finger follower according to a first embodiment.

Certain terminology is used in the following description for convenience only and is not limiting. The words "front," "rear," "upper," and "lower" designate directions in the drawings to which reference is made. The words "inwardly" and "outwardly" refer to directions toward and away from the parts referenced in the drawings. "Axially" refers to a direction along the axis of a shaft or rotating part. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
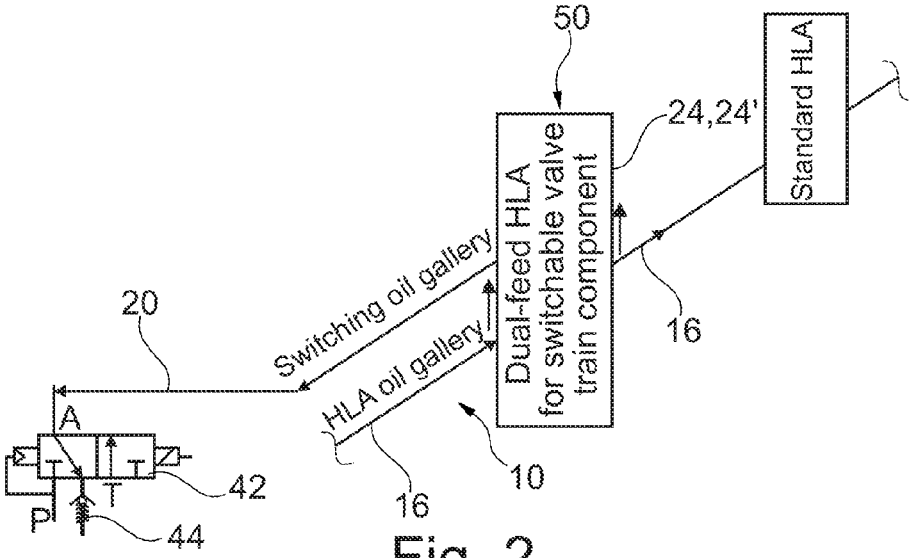
FIG. 2 is a schematic view showing the switching hydraulic fluid gallery de-aeration arrangement in a first position of the switching control valve.
Figure 3:
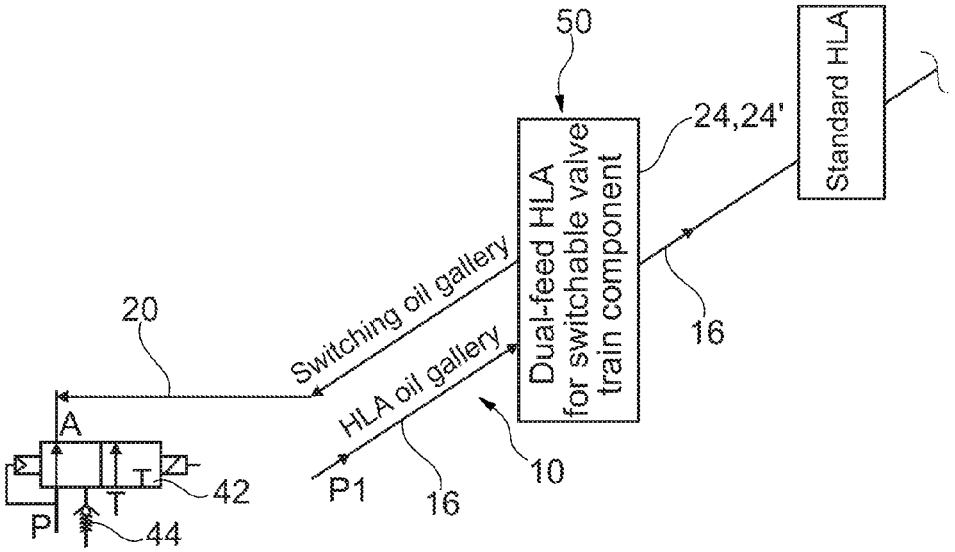
FIG. 3 is a schematic view showing the switching hydraulic fluid gallery de-aeration arrangement in a second position of the switching control valve for carrying out a switching function of the switchable valve arrangement.

Referring to FIGS. 1-4, a switching hydraulic fluid gallery de-aeration arrangement 10 for use in connection with a switchable valve arrangement 50 is shown. The switching hydraulic fluid gallery de-aeration arrangement 10 includes a cylinder head 12 having a bore 14 that is adapted to receive a hydraulic lash adjuster assembly 24. The hydraulic lash adjuster fluid gallery 16, shown in FIGS. 1-3, is also provided in the cylinder head 12 and intersects the bore 14 at a first intersection 18. A switching hydraulic fluid gallery 20 intersects the bore 14 at a second intersection 22, offset axially from the first intersection 18, is also provided in the cylinder head 12. The cylinder head 12 can be made of cast or machined iron or aluminum, and the hydraulic lash adjuster fluid gallery 16 and the switching hydraulic fluid gallery 20 may be formed by boring through solid material to intersect the bores 14 for a number of hydraulic lash adjuster assemblies 24 that provide a dual feed for a switching function, or the galleries 16, 20 can be formed in the head using casting cores that are pre-formed to define the galleries 16, 20.

Figure 4:
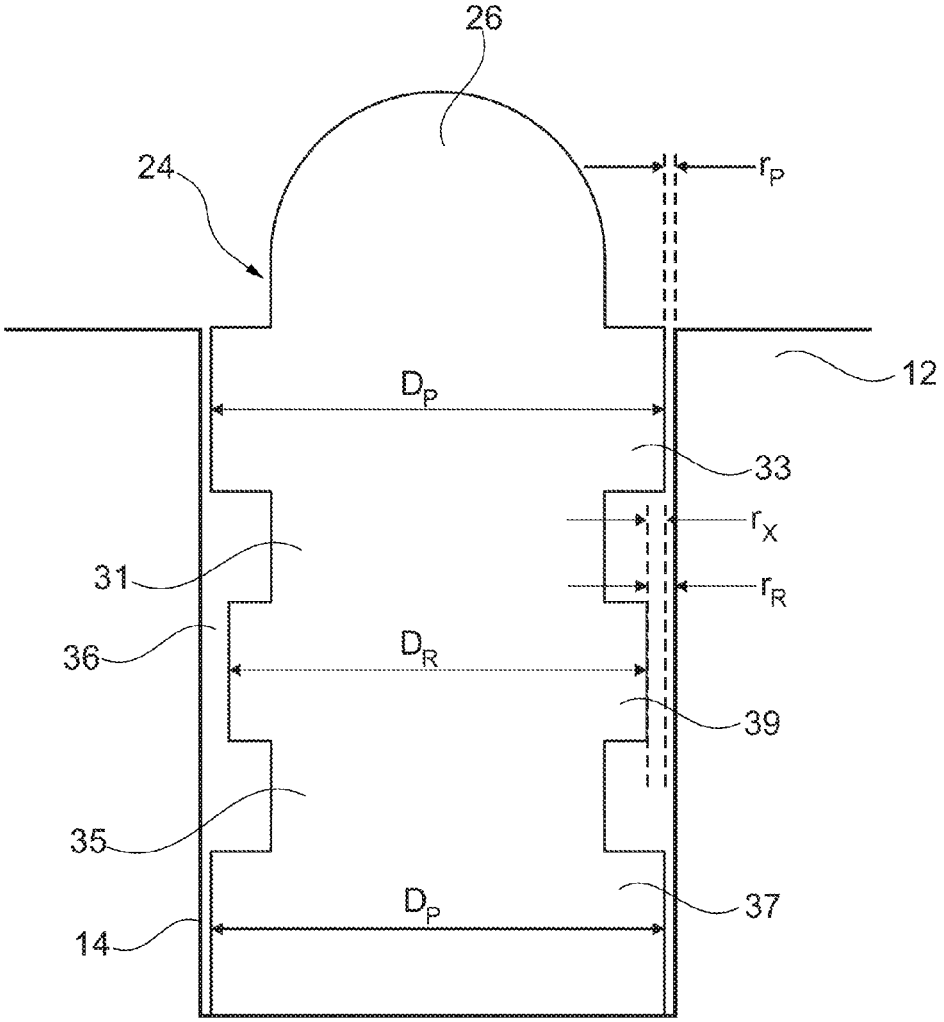
FIG. 4 is a schematic view of a housing of a hydraulic lash adjuster for the switching hydraulic fluid gallery de-aeration arrangement shown in FIGS. 1-3.

Referring to FIGS. 1 and 4, the hydraulic lash adjuster 24 is in the form of a dual feed hydraulic lash adjuster and includes a housing 26 that is positioned in the bore 14 of the cylinder head 12. The housing 26 includes an annular body 28 and has a first, hydraulic lash adjuster fluid port 30 on a radially outer wall 32 of the housing located in a position of the first intersection 18. The first port 30 is located in a first annular groove 31 on the radially outer wall 32 of the housing 26. A second, switching hydraulic fluid port 34 is also located on the radially outer wall 32 of the housing 26 at the second intersection 22. The second port 34 is located in a second annular groove 35 on the radially outer wall 32 of the housing 26.

As shown in FIGS. 1 and 4, a top land 33 is positioned axially above the first annular groove 31. A bottom land 37 is positioned axially below the second annular groove 35. The top land 33 and the bottom land 37 each have a primary outer diameter ($D_P$). In one embodiment, the primary outer diameter ($D_P$) can be 12.000 mm+/−0.005 mm. However, other sizes can be provided. A radial clearance ($r_P$) is defined between both (1) the bore 14 and the top land 33, and (2) the bore 14 and the bottom land 37. The housing 26 is shown positioned directly concentric within the bore 14 in FIG. 4. A total clearance ($2r_P$) between both (1) the bore 14 and the top land 33, and (2) the bore 14 and the bottom land 37 can be between 0.010 mm and 0.030 mm. This provides sufficient space for a lubrication film to be formed that generally remains closed, i.e. not an open flow path, due to the lubricant viscosity and the meniscus force. A middle land 39 of the housing 26 is defined axially between the first annular groove 31 and the second annular groove 35. The middle land 39 has a reduced, constant outer diameter ($D_R$) relative to the primary outer diameter ($D_P$) of the top land 33 and the bottom land 37. The reduced, constant outer diameter ($D_R$) can be 11.985 mm+/−0.005 mm. A difference ($2r_X$) between the primary outer diameter ($D_P$) of the top land 33 and the bottom land 37, and the reduced, constant outer diameter ($D_R$) of the middle land 39 is formed. The difference ($2r_X$) can be 0.015 mm+/−0.010 mm. A restricted flow path 36 with a radial depth ($r_R$) is defined between the bore 14 and the reduced, constant outer diameter ($D_R$) of the middle land 39. Based on the above dimensions, the sum of ($r_P$) and ($r_X$) equals ($r_R$). The radial depth ($r_R$) can be between 0.0075 mm and 0.0275 mm. The restricted flow path 36 is defined between the hydraulic lash adjuster fluid gallery 16 and the switching hydraulic fluid gallery 20 and is sufficient to maintain a limited hydraulic fluid flow to the switching hydraulic fluid gallery 20. The restricted flow path 36 extends circumferentially around an entire circumference of the middle land 39. One of ordinary skill in the art will recognize from the present disclosure that the dimensions for the restricted flow path 36 may be altered depending on a specific hydraulic lash adjuster application.

Figure 5:
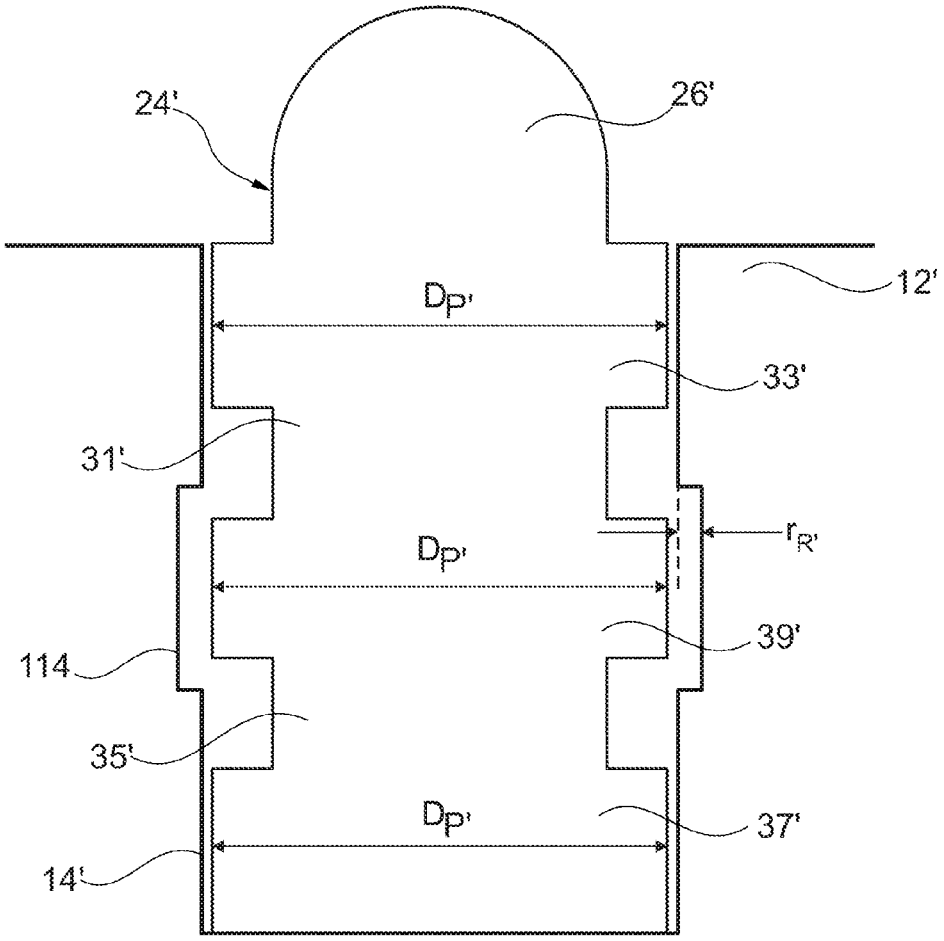
FIG. 5 is a schematic view of a housing of a hydraulic lash adjuster for the switching hydraulic fluid gallery de-aeration arrangement according to a second embodiment.

In another embodiment of the hydraulic lash adjuster 24' and the housing 26' shown in FIG. 5, the top land 33', the middle land 39', and bottom land 37' all have the same outer diameter ($D_{P'}$), and a annular groove 114 is formed in the bore 14' in a region of the middle land 39'. The annular groove 114 provides a restricted flow path between the first annular groove 31' and the second annular groove 35'. The annular groove 114 has a radial depth ($r_{R'}$) that provides the same function as the restricted flow path 36 discussed above.

The housing 26 can be formed as a deep drawn steel part which can be further machined, then hardened and ground to the final configuration. Alternatively, it can be a machined part. A plunger 38 with a support head 40 is arranged within the housing 26 and is axially displaceable therein. The plunger 38 provides a hydraulic lash adjustment function via pressurized hydraulic fluid P1, represented by an arrow in FIG. 1, flowing through the hydraulic lash adjustment fluid gallery 16 through the first port 30. The switching hydraulic fluid gallery 20 feeds pressurized hydraulic fluid for switching a switchable valve arrangement 50 through the second fluid port 34 and through an opening on the support head 40 into the switchable roller finger follower 56 (shown in broken lines in FIG. 1) when activated.

Referring to FIGS. 2 and 3, a switching control valve 42 is connected to a pressurized fluid source P and is adapted to activate or de-activate a switchable valve arrangement 50, shown in FIG. 1. The switchable valve arrangement 50 is generically identified as a dual-feed HLA for a switchable valve train component in FIGS. 2 and 3. The switchable valve train component 50 can include a switchable roller finger follower or a switchable hydraulic lash adjuster. The switchable control valve 42 is movable from a first position, shown in FIG. 2, in which the pressurized hydraulic fluid P1 from the hydraulic lash adjuster fluid gallery 16 flows to the first intersection 18, through the restricted flow path 36, and through the switching hydraulic fluid gallery 20 to a check valve 44 such that pressurized hydraulic fluid P1 from the hydraulic lash adjuster fluid gallery 16 pressurizes the switching hydraulic fluid gallery 20 and is released through the check valve 44 if an overpressure that could possibly actuate the switching function occurs.

The switching control valve 42 is switchable to a second position, shown in FIG. 3, in which the pressurized hydraulic fluid P which has a higher pressure sufficient to carry out a switching function of the switchable valve arrangement 50 is delivered by the switching hydraulic fluid gallery 20 via the second intersection 22 to the port 34 in order to switch to a second lift mode of the switchable valve arrangement 50.

As shown in FIGS. 2 and 3, the hydraulic lash adjuster fluid gallery 16 is also connected to standard hydraulic lash adjusters in order to provide lash adjustment and lubrication.

The switchable valve arrangement 50 shown in FIGS. 1-4 includes switchable roller finger followers 56 with hydraulically actuated locking assembly 58 that are switchable between two lift modes as discussed above in connection with U.S. Pat. No. 7,909,007, which is incorporated herein by reference as if fully set forth. This transfers the cam lift from the cam 54 to the stem 52 of a gas exchange valve in a lift mode, and can be switched to a no lift mode when activated.

In the first position of the switching control valve 42, as shown in FIG. 2, the check valve 44 is located between the switching hydraulic fluid gallery 20 and a tank connection T. The check valve 44 is between the control valve 42 and tank T. The check valve 44 is set to release at a pressure of about 0.1 bar or greater. This ensures that the switchable valve arrangement 50 is not inadvertently activated during de-aeration of the switching hydraulic fluid gallery 20 via the hydraulic fluid from the hydraulic lash adjustment hydraulic fluid gallery 16 being provided at too high of a pressure. In this first position of the switching control valve 42, the lower pressure hydraulic fluid from the hydraulic lash adjustment fluid gallery 16 clears any air bubbles from the switching hydraulic fluid gallery 20 during the entire time the engine is operating with the switching control valve 42 in the first position. This ensures that there is a solid column of hydraulic fluid in the switching hydraulic fluid gallery so that upon activation of the switching control valve 42 to the second position, the switching reaction time is nearly instantaneous due to the switching hydraulic fluid gallery 20 not including trapped air bubbles, which would reduce the switching reaction time.

One of ordinary skill in the art will recognize from the present disclosure that the de-aeration arrangement 10, shown in FIGS. 1-4, can also be used in connection with a switchable valve arrangement 50 that includes switchable hydraulic lash adjuster assemblies that are switchable between two lift modes, as discussed above in connection with U.S. Pat. No. 8,235,017.

A method of de-aerating a switchable hydraulic fluid gallery 20 for a switchable valve arrangement 50 of an internal combustion engine is also provided. The method includes providing a switching hydraulic fluid gallery de-aeration arrangement 10 as described above and feeding pressurized hydraulic fluid from the hydraulic lash adjuster fluid gallery 16 to the first intersection 18, through the restricted flow path 36, and through the switching hydraulic fluid gallery 20 to the check valve 44 so that pressurized hydraulic fluid from the hydraulic lash adjuster fluid gallery 16 pressurizes the switching hydraulic fluid gallery 20 in the first position and air bubbles in the hydraulic fluid in the switching hydraulic fluid gallery 20 that would otherwise be trapped are carried to a tank connection prior to the switching control valve 42 being moved to the second position.

It is to be appreciated and will be apparent to those skilled in the art that many physical changes, only a few of which are exemplified in the detailed description, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the application being indicated by the appended claims rather than by the foregoing description, and all alternate embodiments and changes to this embodiment which come within the meaning and range of equivalency of said claims are therefore to be embraced therein.

LIST OF REFERENCES switching hydraulic fluid gallery de-aeration arrangement 10
cylinder head 12
bore 14
hydraulic lash adjuster fluid gallery 16
first intersection 18
switching hydraulic fluid gallery 20
second intersection 22
hydraulic lash adjuster assembly 24
housing 26
annular body 28
first, hydraulic lash adjuster fluid port 30
first annular groove 31
radially outer wall 32
top land 33
second, switching hydraulic fluid port 34
second annular groove 35
restricted flow path 36
bottom land 37
plunger 38
middle land 39
support head 40
switching control valve 42
check valve 44
switchable valve arrangement 50
stem 52
cam 54
switchable roller finger followers 56
annular groove 114

What is claimed is:

1. A switching hydraulic fluid gallery de-aeration arrangement for a switchable valve arrangement, comprising:

a cylinder head including a bore, a hydraulic lash adjuster fluid gallery that intersects the bore at a first intersection, and a switching hydraulic fluid gallery that intersects the bore at a second intersection offset from the first intersection;

a hydraulic lash adjuster assembly comprising:

a housing positioned in the bore of the cylinder head including a first, hydraulic lash adjuster fluid port on a radially outer wall in a first annular groove of the housing at the first intersection, a second switching hydraulic fluid port on the radially outer wall in a second annular groove of the housing at the second intersection, a top land positioned axially above the first annular groove, a bottom land positioned axially below the second annular groove, the top land and the bottom land each have a primary outer diameter ($D_P$), a middle land defined axially between the first annular groove and the second annular groove;

a plunger arranged within the housing that is axially displaceable therein; and a restricted flow path defined between the hydraulic lash adjuster fluid gallery and the switching hydraulic fluid gallery to maintain hydraulic fluid in the switching hydraulic fluid gallery formed by at least one of:

(a) the middle land having a reduced outer diameter ($D_R$) relative to the primary outer diameter ($D_P$), or (b) an annular groove formed in the bore of the cylinder head in a region of the middle land having a radial depth ($r_{R'}$), a switching control valve connected to a pressurized fluid source, the switching control valve being adapted to activate or deactivate the switchable valve arrangement, the switching control valve is movable from:

(1) a first position, in which pressurized hydraulic fluid from the hydraulic lash adjuster fluid gallery flows to the first intersection, through the restricted flow path and the switching hydraulic fluid gallery to a check valve such that pressurized hydraulic fluid from the hydraulic lash adjuster fluid gallery pressurizes the switching hydraulic fluid gallery and is released through the check valve, and (2) a second position, in which pressurized hydraulic fluid having a higher pressure sufficient for carrying out a switching function of the switchable valve arrangement is delivered by the switching hydraulic fluid gallery via the second intersection to the second port.

2. The switching hydraulic fluid gallery de-aeration arrangement of claim 1, wherein the restricted flow path is defined by the middle land having the reduced outer diameter ($D_R$), and the reduced outer diameter ($D_R$) is constant.

3. The switching hydraulic fluid gallery de-aeration arrangement of claim 1, wherein a total radial clearance ($2r_P$) defined between both (1) the top land and the bore, and (2) the bottom land and the bore is between 0.010 mm and 0.030 mm.

4. The switching hydraulic fluid gallery de-aeration arrangement of claim 1, wherein the restricted flow path is defined by the middle land having the reduced outer diameter ($D_R$), and a difference ($2r_X$) between the primary outer diameter ($D_P$) and the reduced outer diameter ($D_R$) is between 0.005 mm and 0.025 mm.

5. The switching hydraulic fluid gallery de-aeration arrangement of claim 1, wherein the primary outer diameter ($D_P$) is between 11.995 mm and 12.005 mm.

6. The switching hydraulic fluid gallery de-aeration arrangement of claim 1, wherein the restricted flow path is defined by the middle land having the reduced outer diameter ($D_R$), and the reduced outer diameter ($D_R$) is between 11.980 mm and 11.990 mm.

7. The switching hydraulic fluid gallery de-aeration arrangement of claim 1, wherein the hydraulic lash adjuster assembly is switchable between two lift modes.

8. The switching hydraulic fluid gallery de-aeration arrangement of claim 1, further comprising a switchable roller finger follower with a hydraulically actuated locking assembly that is switchable between two lift modes.

9. The switching hydraulic fluid gallery de-aeration arrangement of claim 1, wherein in the first position the check valve is located between the switching hydraulic fluid gallery and a tank connection.

10. The switching hydraulic fluid gallery de-aeration arrangement of claim 9, wherein the check valve is set to release at a pressure of about 0.1 bar or greater.

11. The switching hydraulic fluid gallery de-aeration arrangement of claim 1, wherein the hydraulic lash adjuster fluid gallery is also connected to standard hydraulic lash adjusters.

12. A hydraulic lash adjuster for de-aerating a hydraulic fluid gallery for a switchable valve arrangement, comprising:

a housing adapted to be positioned in a bore of a cylinder head, the housing including a first, hydraulic lash adjuster fluid port on a radially outer wall in a first annular groove of the housing, a second switching hydraulic fluid port on the radially outer wall in a second annular groove of the housing, a top land positioned axially above the first annular groove, a bottom land positioned axially below the second annular groove, the top land and the bottom land each have a primary outer diameter ($D_P$), a middle land defined axially between the first annular groove and the second annular groove, the middle land has a reduced outer diameter ($D_R$) relative to the primary outer diameter ($D_P$), and a restricted flow path is defined between the hydraulic lash adjuster fluid port and the switching hydraulic fluid port when the housing is positioned in the bore of the cylinder head.

13. The hydraulic lash adjuster of claim 12, wherein the reduced outer diameter ($D_R$) is between 11.980 mm and 11.990 mm.

14. The hydraulic lash adjuster of claim 12, wherein the reduced outer diameter ($D_R$) is constant.

15. The hydraulic lash adjuster of claim 12, wherein a difference ($2r_X$) between the primary outer diameter ($D_P$) and the reduced outer diameter ($D_R$) is between 0.005 mm and 0.025 mm.

16. A method of de-aerating a switching hydraulic fluid gallery for a switchable valve arrangement of an internal combustion engine, the method comprising:

providing a switching oil gallery de-aeration arrangement having a cylinder head including a bore, a hydraulic lash adjuster fluid gallery that intersects the bore at a first intersection, and a switching hydraulic fluid gallery that intersects the bore at a second intersection axially offset from the first intersection; a hydraulic lash adjuster assembly including a housing positioned in the bore of the cylinder head including an annular body that includes a first, hydraulic lash adjuster fluid port on a radially outer wall of the housing at the first intersection in a first annular groove, a second switching hydraulic fluid port on the radially outer wall of the housing at the second intersection in a second annular groove, a top land positioned axially above the first annular groove, a bottom land positioned axially below the second annular groove, the top land and the bottom land each have a primary outer diameter, a middle land defined axially between the first annular groove and the second annular groove, and a plunger arranged within the housing that is axially displaceable therein; and a switching control valve connected to a pressurized fluid source;

at least one of (1) reducing an outer diameter of the middle land to a reduced, outer diameter relative to the primary outer diameter or (2) providing an annular groove in the bore in the cylinder head in an area between the top land and the bottom land, such that a restricted flow path is defined between the hydraulic lash adjuster fluid gallery and the switching hydraulic fluid gallery to maintain hydraulic fluid in the switching hydraulic fluid gallery, the switching control valve being adapted to activate or deactivate a switchable valve arrangement, the switching control valve is movable from a first position, in which pressurized hydraulic fluid from the hydraulic lash adjuster fluid gallery flows to the first intersection, through the restricted flow path and through the switching hydraulic fluid gallery to a check valve so that pressurized hydraulic fluid from the hydraulic lash adjuster fluid gallery pressurizes the switching hydraulic fluid gallery, and a second position, in which pressurized hydraulic fluid having a higher pressure sufficient for carrying out a switching function of the switchable valve arrangement is delivered by the switching hydraulic fluid gallery via the second to the second port; and feeding pressurized hydraulic fluid from the hydraulic lash adjuster fluid gallery flows to the first intersection, through the restricted flow path and through the switching hydraulic fluid gallery to the check valve so that pressurized hydraulic fluid from the hydraulic lash adjuster fluid gallery pressurizes the switching hydraulic fluid gallery in the first position so that air bubbles in the hydraulic fluid in the switching hydraulic fluid gallery are carried to a tank connection prior to the switching control valve being moved to the second position.

* * * * *